US006179290B1

(12) United States Patent
Maahs

(10) Patent No.: US 6,179,290 B1
(45) Date of Patent: Jan. 30, 2001

(54) METHOD OF PLAYING A POKER GAME INCLUDING A PROGRESSIVE JACKPOT

(76) Inventor: Karl Andrew Maahs, 03 Palacio Ct., Los Lunas, NM (US) 87031

( * ) Notice: Under 35 U.S.C. 154(b), the term of this patent shall be extended for 0 days.

(21) Appl. No.: 08/774,968

(22) Filed: Dec. 26, 1996

(51) Int. Cl.[7] ..... A63F 1/00
(52) U.S. Cl. ..... 273/292
(58) Field of Search ..... 273/292, 274, 273/309

(56) References Cited

U.S. PATENT DOCUMENTS 4,836,553 6/1989 Suttle ..... 273/292
5,415,414 * 5/1995 Savage ..... 273/306

OTHER PUBLICATIONS

Scarne, John, Scarne's Encyclopedia of Games, Harper & Row Publishers, 1973, p. 41.

* cited by examiner

*Primary Examiner*—Benjamin H. Layno

(57) ABSTRACT

Casino Poker games are described in which a plurality of independent progressive jackpots are included in the game. Each player choosing to participate in a round is automatically eligible to win the jackpots. In certain embodiments of the game, a qualifying hand is used which either must be beaten by the dealer or the players. The qualifying hand is dealt for each round of play and is not a fixed qualifier.

34 Claims, 7 Drawing Sheets

QUALIFIER
2-S
2-C

DEALER'S HAND
A-C
A-H
4-D
4-C
3-C

| PLAYER NO. | 5 | 4 | 3 | 2 | 1 |
|---|---|---|---|---|---|
| | A-D | Q-D | A-H | 9-C | 6-D |
| | 10-H | Q-C | J-D | 9-H | 6-H |
| | 5-S | J-H | 8-S | 8-C | K-C |
| | 4-S | 2-C | 6-H | 8-D | 10-C |
| | 2-H | 7-S | 5-H | 4-H | 7-D |
| ANTE | $5 | $5 | $5 | $5 | $5 |
| ODDS | $5 | $5 | $5 | $10 | $5 |
| $ WIN/ LOSS: | L $5 | L $10 | L $5 | L $15 | L $10 |
| QUALIF Y/N | N | Y | N | Y | Y |

DEALER

A–C
A–H
Q–H
4–D
3–C

| PLAYER NO. | 5 | 4 | 3 | 2 | 1 |
|---|---|---|---|---|---|
| | A–D | Q–D | A–H | 9–C | 6–D |
| | 10–H | Q–C | J–D | 9–H | 6–H |
| | 5–S | J–H | 8–S | 8–C | K–C |
| | 4–S | 2–C | 6–H | 8–D | 10–C |
| | 2–H | 7–S | 5–H | 4–H | 7–D |
| ANTE | $5 | $5 | $5 | $5 | $5 |
| ODDS | $5 | $5 | $5 | $10 | $5 |
| $ WIN/ LOSS: | L $10 | L $10 | L $10 | $14 | L $10 |

FIG. 2

DEALER

5–H
5–D
2–C
2–D
2–S

| PLAYER NO. | 5 | 4 | 3 | 2 | 1 |
|---|---|---|---|---|---|
| | | 9–H | A–C | 10–H | A–H |
| | | 9–D | 4–H | 9–C | K–D |
| | | 6–H | 4–D | 8–C | 9–S |
| | | 6–C | 4–C | 7–H | 5–C |
| | | 6–S | 4–S | 6–D | 3–C |
| ANTE | | $5 | $5 | $5 | $5 |
| ODDS | | $10 | – | $10 | $5 |
| $ WIN/ LOSS: | | $84 | Jackpot 3 | L $15 | L $10 |

FIG. 3

DEALER
10-H
6-C
5-C
3-H
2-C

| PLAYER NO. | 5 | 4 | 3 | 2 | 1 |
|---|---|---|---|---|---|
| | 9-D | 7-H | A-H | 6-D | A-D |
| | 8-H | 7-D | K-H | 5-D | K-D |
| | 5-S | 7-C | Q-H | 4-D | 9-H |
| | 4-S | 7-S | J-H | 3-D | 8-S |
| | 3-S | 2-H | 10-H | 2-D | 2-S |
| ANTE | $5 | $5 | $5 | $5 | $5 |
| ODDS | F | – | – | – | $5 |
| $ WIN/ LOSS: | L $5 | Jackpot 3 | Jackpot 1 | Jackpot 2 | $9 |

FIG. 4

QUALIFIER
2-S
2-C

DEALER'S HAND
A-C
A-H
4-D
4-C
3-C

| PLAYER NO. | 5 | 4 | 3 | 2 | 1 |
|---|---|---|---|---|---|
| | A-D | Q-D | A-H | 9-C | 6-D |
| | 10-H | Q-C | J-D | 9-H | 6-H |
| | 5-S | J-H | 8-S | 8-C | K-C |
| | 4-S | 2-C | 6-H | 8-D | 10-C |
| | 2-H | 7-S | 5-H | 4-H | 7-D |
| ANTE | $5 | $5 | $5 | $5 | $5 |
| ODDS | $5 | $5 | $5 | $10 | $5 |
| $ WIN/ LOSS: | L $5 | L $10 | L $5 | L $15 | L $10 |
| QUALIF Y/N | N | Y | N | Y | Y |

FIG. 5

| | | | | | |
|---|---|---|---|---|---|
| | | QUALIFIER | | DEALER'S HAND | |
| | | Q-H | | 5-H | |
| | | J-S | | 5-D | |
| | | | | 2-C | |
| | | | | 2-D | |
| | | | | 2-S | |
| PLAYER NO. | 5 | 4 | 3 | 2 | 1 |
| | | 9-H | A-C | 10-H | A-H |
| | | 9-D | 4-H | 9-C | K-D |
| | | 6-H | 4-D | 8-C | 9-S |
| | | 6-C | 4-C | 7-H | 5-C |
| | | 6-S | 4-S | 6-D | 3-C |
| ANTE | | $5 | $5 | $5 | $5 |
| ODDS | | $10 | – | $10 | $5 |
| $ WIN/ LOSS: | | W $84 | Jackpot 3 | L $15 | L $10 |
| QUALIF Y/N | | Y | – | Y | Y |

FIG. 6

| | | | | | |
|---|---|---|---|---|---|
| | | QUALIFIER | | DEALER'S HAND | |
| | | 9-C | | 10-H | |
| | | 8-C | | 6-C | |
| | | | | 5-C | |
| | | | | 3-H | |
| | | | | 2-C | |
| PLAYER NO. | 5 | 4 | 3 | 2 | 1 |
| | 9-D | 7-H | A-H | 6-D | A-D |
| | 8-H | 7-D | K-H | 5-D | K-D |
| | 5-S | 7-C | Q-H | 4-D | 9-H |
| | 4-S | 7-S | J-H | 3-D | 8-S |
| | 3-S | 2-H | 10-H | 2-D | 2-S |
| ANTE | $5 | $5 | $5 | $5 | $5 |
| ODDS | F | – | – | – | $5 |
| $ WIN/ LOSS: | L $5 | Jackpot 3 | Jackpot 1 | Jackpot 2 | W $9 |
| QUALIF Y/N | – | – | – | – | Y |

FIG. 7

| QUALIFIER | DEALER'S HAND |
|---|---|
| 5-C | A-C |
| 2-S | A-H |
| | 4-D |
| | 3-C |
| | 2-C |

| PLAYER NO. | 5 | 4 | 3 | 2 | 1 |
|---|---|---|---|---|---|
| | A-D | Q-D | A-H | 9-C | 6-D |
| | 10-H | Q-C | J-D | 9-H | 6-H |
| | 5-S | J-H | 8-S | 8-C | K-C |
| | 4-S | 2-C | 5-D | 8-D | 10-C |
| | 2-H | 7-S | 5-H | 4-H | 7-D |
| ANTE | $5 | $5 | $5 | $5 | $5 |
| ODDS | $5 | $5 | $5 | $10 | $5 |
| $ WIN/ | – | – | – | – | – |
| LOSS: | L $10 | L $10 | L $10 | W $14 | L $10 |

FIG. 8

| QUALIFIER | DEALER'S HAND |
|---|---|
| Q-H | 5-H |
| 2-S | 5-D |
| | 2-C |
| | 2-D |
| | J-S |

| PLAYER NO. | 5 | 4 | 3 | 2 | 1 |
|---|---|---|---|---|---|
| | | 9-H | A-C | 10-H | A-H |
| | | 9-D | 4-H | 9-C | K-D |
| | | 6-H | 4-D | 8-C | 9-S |
| | | 6-C | 4-C | 7-H | 5-C |
| | | 6-S | 4-S | 6-D | 3-C |
| ANTE | | $5 | $5 | $5 | $5 |
| ODDS | | $10 | $- | $10 | $5 |
| $ WIN/ LOSS: | | $84 | Jackpot 3 | W $34 | L $10 |

FIG. 9

| QUALIFIER | DEALER'S HAND |
|---|---|
| A–H | 10–H |
| J–C | 6–C |
| | 5–C |
| | 9–C |
| | 8–C |

| PLAYER NO. | 5 | 4 | 3 | 2 | 1 |
|---|---|---|---|---|---|
| | 9–D | 7–H | A–H | 6–D | A–D |
| | 8–H | 7–D | K–H | 5–D | K–D |
| | 5–S | 7–C | Q–H | 4–D | 9–H |
| | 4–S | 7–S | J–H | 3–D | 8–C |
| | 3–S | 2–H | 10–H | 2–D | 2–S |
| ANTE | $5 | $5 | $5 | $5 | $5 |
| ODDS | F | – | – | – | $5 |
| $ WIN/ LOSS: | L $5 | Jackpot 3 | Jackpot 1 | Jackpot 2 | W $9 |

FIG. 10

| QUALIFIER | DEALER'S HAND |
|---|---|
| A–S | A–C |
| Q–S | A–H |
| J–S | Q–H |
| 10–S | 4–D |
| 10–D | 3–C |

| PLAYER NO. | 5 | 4 | 3 | 2 | 1 |
|---|---|---|---|---|---|
| | A–D | Q–D | A–H | 9–C | 6–D |
| | 10–H | Q–C | J–D | 9–H | 6–H |
| | 5–S | J–H | 8–S | 8–C | K–C |
| | 4–S | 2–C | 6–H | 8–D | 10–C |
| | 2–H | 7–S | 5–H | 4–H | 7–D |
| ANTE | $5 | $5 | $5 | $5 | $5 |
| ODDS | $5 | $5 | $5 | $10 | $5 |
| $ WIN/ LOSS: | L $10 | L $10 | L $10 | W $14 | L $10 |

FIG. 11

| QUALIFIER | DEALER'S HAND |
|---|---|
| A-S | 5-H |
| Q-S | 5-D |
| J-S | 2-C |
| 10-S | 2-D |
| 10-D | 2-S |

| PLAYER NO. | 5 | 4 | 3 | 2 | 1 |
|---|---|---|---|---|---|
| | | 9-H | A-C | 10-H | A-H |
| | | 9-D | 4-H | 9-C | K-D |
| | | 6-H | 4-D | 8-C | 9-S |
| | | 6-C | 4-C | 7-H | 5-C |
| | | 6-S | 4-S | 6-D | 3-C |
| ANTE | | $5 | $5 | $5 | $5 |
| ODDS | | $10 | – | $10 | $5 |
| $ WIN/ LOSS: | | W $84 | Jackpot 3 | L $15 | L $10 |

FIG. 12

| QUALIFIER | DEALER'S HAND |
|---|---|
| A-S | 10-H |
| Q-S | 6-C |
| J-S | 5-C |
| 10-S | 3-H |
| 10-D | 2-C |

| PLAYER NO. | 5 | 4 | 3 | 2 | 1 |
|---|---|---|---|---|---|
| | 9-D | 7-H | A-H | 6-D | A-D |
| | 8-H | 7-D | K-H | 5-D | K-D |
| | 5-S | 7-C | Q-H | 4-D | 9-H |
| | 4-S | 7-S | J-H | 3-D | 8-C |
| | 3-S | 2-H | 10-H | 2-D | 2-S |
| ANTE | $5 | $5 | $5 | $5 | $5 |
| ODDS | F | – | – | – | $5 |
| $ WIN/ LOSS: | L $5 | Jackpot 3 | Jackpot 1 | Jackpot 2 | L $10 |

FIG. 13

METHOD OF PLAYING A POKER GAME INCLUDING A PROGRESSIVE JACKPOT

BACKGROUND OF THE INVENTION

This invention pertains to casino gaming, in general, and to a casino card game, in particular.

Casino card games having a jackpot feature have become common practice. Several different card games have been developed for casino application in which a progressive jackpot feature is added to increase the attractiveness of the game for players. U.S. Pat. Nos. 4,861,041; 4,836,553, 5,288,077 and 5,364,105 describe card games having a progressive jackpot feature. Each of the games described in these patents has the common feature that a player wagers a first bet or ante to participate in the card game and must wager a separate second bet to participate in a jackpot feature of the game. Thus, the participation in the jackpot is always optional.

After the player has wagered the two bets, the cards are dealt. The player looks at his/her cards and must decide to either fold his/her cards, in which case, the player loses both his/her ante and second bets, or wage another bet which is a multiple of the first bet. If the player's hand beats the dealer's hand, the player wins an amount which is determined by the rank of his/her hand according to the game being played. If the player's hand is a predetermined rank, the player wins a portion of a progressive jackpot. The amount of money in the jackpot is determined by the number of players which have paid the optional second wager to participate in the jackpot. The second wagers for each hand are added to the jackpot.

SUMMARY OF THE INVENTION

In a card game, in accordance with the principles of the invention, each and every player is automatically a participant in a jackpot component of the game. When a player wagers a first bet or ante, the player is a participant of the card game. Each participant is automatically eligible to win a jackpot component. The jackpot component includes a plurality of independent jackpots each of which is progressive. Each of the jackpots is funded from a predetermined amount which is withheld from each winning players' payouts for each round of hands. The withheld winnings from each hand are divided among the plurality of jackpots in accordance with a preselected formula.

Further, in accordance with the principles of the invention, each player which, after wagering a single bet or ante to participate in the game, is dealt a hand of cards. If the hand dealt to a player has a rank which is identified as a rank winning one of the plurality of jackpots, the player without any further betting immediately wins the corresponding jackpot. If the player does not have a jackpot winning hand, the player must decide to either fold or wage an odds bet. In the event that a player does not have one of the predetermined jackpot winning ranks, but has a hand which beats the hand of the dealer, the dealer pays the player even money on the first bet and predetermined odds on the second bet.

Still further in accordance with the invention, each game may include a qualifier hand which is formed for each round of hands dealt, and which each player must beat in order to qualify to play against the dealer's hand. In one embodiment of the invention, the dealer deals cards utilized to form a second highest hand, utilizing poker ranking, as a qualifier. In accordance with the invention, the dealer always qualifies but each player must have a hand with a poker rank which is at least higher than the qualifier hand. In the event that the player's hand is not higher than the qualifier hand, the player loses his/her first or ante bet.

Still further in accordance with the invention, in a third embodiment of the invention, the dealer always deals a predetermined number of cards in each game as a qualifying hand. After the players have waged their second bet, the qualifier hand is turned face up. Any player who does not beat the qualifier hand, loses his/her first or ante bet. If a player does, in fact, beat the qualifier hand, then the player qualifies to play against the dealer hand. In the event that the player's hand qualifies and is higher than the dealer's hand utilizing standard poker ranking, the dealer pays off the ante bet at even money and pays the odds bet at the predetermined odds. In accordance with the invention, a predetermined fixed amount from each and every winning of a player adds to the progressive jackpot.

In yet a fourth embodiment, a predetermined number of cards is dealt in each round as a qualifier hand. In this instance, however, the dealer must beat the qualifier hand utilizing poker ranking. If the dealer does not beat the qualifier hand, the dealer pays each player even money on the first or ante bet.

BRIEF DESCRIPTION OF THE DRAWINGS

The invention will be better understood from a reading of the following detailed description taken in conjunction with the drawing in which:

FIGS. 2 through 13 show rounds of hands played in accordance with the principles of the invention.

DETAILED DESCRIPTION

Figure 1:
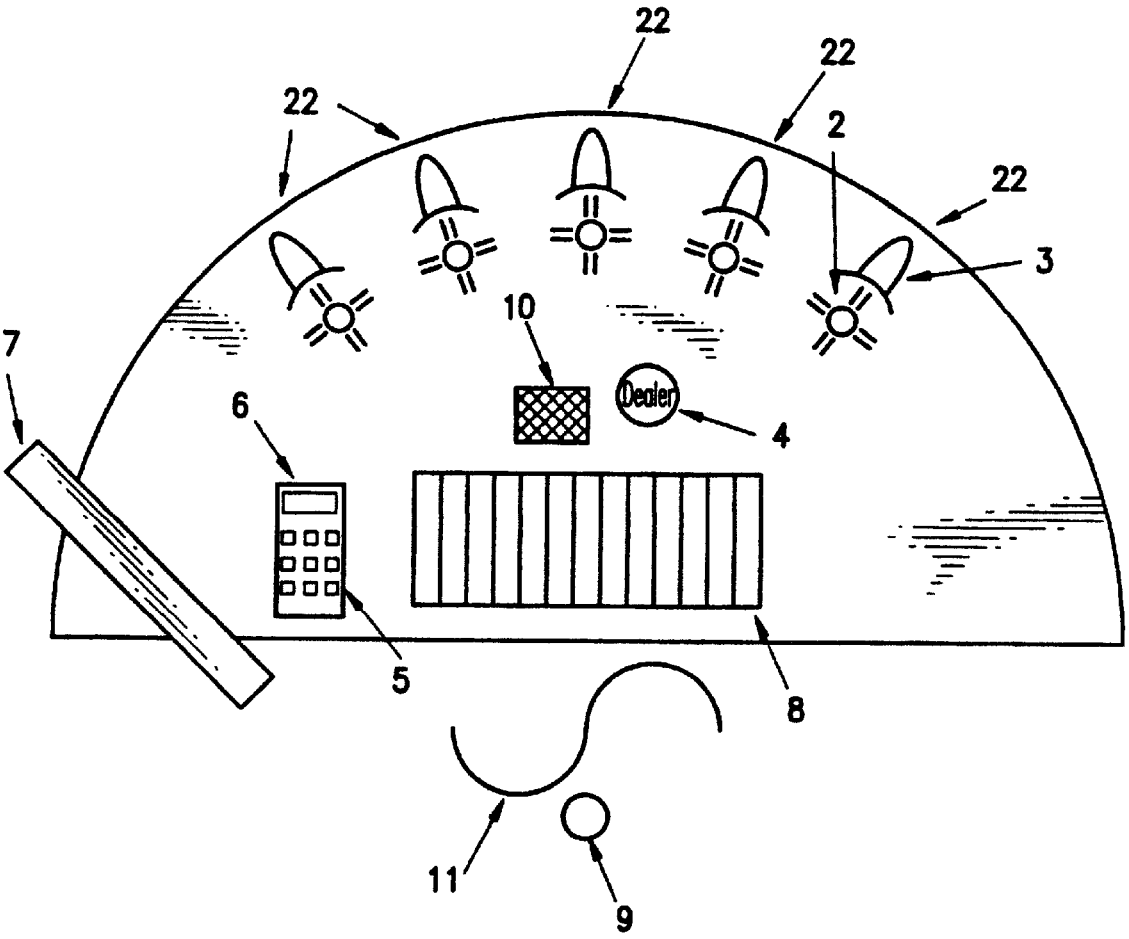
FIG. 1 shows a table layout for playing the games of the invention.

The present invention is a casino game in which the house acts as the banker and the house collects all losing wagers and pays all winning wagers. Dealer 9 is employed by the house. Dealer 9 also functions as banker, and each player plays exclusively against the house. There is no competition between the players.

The table layout shown in the FIG. 1 is on the top of a conventional gaming table, such as a black jack table. Various playing locations 22, are provided for the players. Each player location 22 has designated areas 2 and 3 for the placing of bets. On the table shown, there are five player positions 22. The dealer's position 11, is centrally located at the table. Dealer 9 has a bank or chip rack 8 of conventional design used to hold poker chips or other gaming tokens. Dealer 9 uses the bank 8 to store the chips or gaming tokens that belong to the house. When a player loses his/her wager to the house, the gaming tokens won by the house are stored in the bank 8. When a player wins a hand, the player is paid from gaming tokens stored in the bank 8. Also positioned on the table is a dealer button 4. Dealer button 4 may be used to determine who will be dealt the first card, the same as is utilized on a standard poker table. Dealer button 4 is moved clockwise from player to player after each hand is played. Dealer button 4 may or may not be used in a game and has no significant effect on the operation of a game other than to determine which player receives the first card.

The game utilizes a standard fifty-two card deck 10 of suited playing cards as is commonly used in casinos. In the illustrative game, five card stud is played and the well known priority ranking of winning hands as determined by conventional rules of poker, is used. Five card poker hands are ranked as set forth in Table 1:

TABLE 1

| |
|---|
| 1. Royal Flush |
| 2. Straight Flush |
| 3. Four of a Kind |
| 4. Full House |
| 5. Flush |
| 6. Straight |
| 7. Three of a Kind |
| 8. Two Pair |
| 9. One Pair |
| 10. High card |

The ranking is shown in Table 1 in descending order with Royal Flush being the highest rank.

In the game of the present invention, a progressive jackpot feature is included. With the progressive jackpot feature, three jackpots are provided. The jackpots correspond to the three highest poker ranks shown in the table above and are referred to as jackpot 1, jackpot 2 and jackpot 3, respectively. The jackpots, in addition to being progressive, are independent of each other. The jackpots are seeded by the house. Additional money for the progressive jackpots comes from withholding $1 from each winning player's total payoff. At the end of each hand, dealer 9 will count the number of winning hands on the table and will enter the number into the system by pushing the number on the keypad 5 that corresponds with the number of winning hands on the table, followed by pushing "#" on the keypad. The keypad includes a display 6 which will show the entry by dealer 9. After dealer 9 pushes the "#" key, the display 6, as well as a larger display 7, which is visible to the players, shows the amounts in the three jackpots. The display system automatically splits the amounts that have been entered by dealer 9 into percentages that have been predetermined by the casino. In an illustrative game, the recommended splits are 35% to the top jackpot, 25% to the second jackpot, 15% to the third jackpot and 25% to the house to recover the cost of seeding the jackpots and to provide a profit to the house. These amounts withheld from the winnings, will be added to the jackpot at the three tiered rates. The jackpot amounts are displayed on the display sign 7 and on the keyboard display 6 at alternating times so as to create excitement of the three separate jackpots growing together, yet independent of each other. The top jackpot will be awarded to a player who receives a hand having a poker ranking of Royal Flush. The second jackpot will be awarded to the player who has a poker hand with a ranking of a Straight Flush, and a third jackpot will be awarded to a player who has a poker hand of Four of a Kind.

In each instance, 100% of the corresponding jackpot is won by the player. As noted above, each jackpot is seeded by the house initially. In the illustrative embodiment, the first stage jackpot for a Royal Flush is seeded with $20,000; the second stage jackpot is seeded at $2,000; and the third stage jackpot is seeded at $500. In the rare event that two or more players have a jackpot hand for the same jackpot dealt to them on the same hand, that jackpot will be divided equally between the players.

In addition to the jackpot, other payouts are made directly from the house bank which do not affect the jackpots. The payouts are odds bets made from the house bank and are as shown in Table 2:

TABLE 2

| RANK | PAYOUT |
|---|---|
| Full House | 8-to-1 |
| Flush | 4-to-1 |
| Straight | 3-to-1 |
| Three of a Kind | 2-to-1 |
| Two Pairs or less | 1-to-1 |

In addition to the payout structure as shown above, it should be noted, in the illustrative game, one dollar is supplied to the jackpots from each winning payouts. For poker rank hands that are Royal Flush, Straight Flush or Four of a Kind, the winnings are paid only from the progressive jackpots.

The keypad 5, along with the display 7, may be any of a number of commercially available data entry and display arrangements available. Contained within keypad 5 is a microprocessor and memory which are used to calculate the amounts to be added to each jackpot.

GAME I

In accordance with the principles of the invention, the game is played as follows. Initially, each player desiring to play, must place an ante bet on the table symbol 2 in front of him/her. By placing an ante bet, two things occur. First, the player becomes a participant in the hand that is about to be dealt and secondly, the player is automatically eligible to win one of the progressive jackpots. Each and every player in the game is eligible to win a jackpot at no additional cost or optional wager. Dealer 9 shuffles the cards and then proceeds to deal a hand of five cards to each of the players and to himself utilizing any conventional method of dealing cards. Standard five card stud poker rules are utilized with the players cards being dealt all face down, and cards that are dealt to dealer 9 are dealt four cards down and the last dealer card is dealt face up.

Each then looks at the dealt hand. At that time, one of three things occurs, i.e, the player wins one of the three jackpots, or if the player does not have a jackpot winning hand he must either fold or bet. The player may decide to fold, in which event, the player loses his/her first bet or ante to the house. The player may like the hand dealt and decide to stay in the game. The player stays in the game by wagering an odds bet. The odds bet is placed on the symbol 3, just like the odds on the passline bet in the version of the dice game commonly known as bankers craps. The bet can be any amount up to double the flat or ante bet which is placed on symbol 2. In addition to these two conventional options, the third thing that may occur when the player looks at the dealt hand is that the hand is one of the jackpot winning hands. In that event, the player turns over the hand and automatically wins the corresponding jackpot. For example, if a player initially decides to play a round, he places an ante bet on symbol 2. The cards are dealt face down to all the players who have anted. The cards dealt to dealer 9 are face down except for the last card, which is turned over to be face up. The player may then pick up his/her cards. If the hand that the player has is a Royal Flush, Straight Flush or Four of a Kind, the player immediately wins the corresponding progressive jackpot. If the hand is not a jackpot winning hand, the player must decide whether or not to continue play.

Each of the rest of the players may continue the round playing against the house. After all the players at the table have made their determination as to whether or not to wager an odds bet or to fold, dealer 9 turns the dealer's cards over so that all the players can see the dealer's hand. If a player has a higher hand than the house, the house will pay the player on both the ante as well as the odds bet. If dealer 9 has a hand greater than the player's hand, the player will lose both wagers to the house. The house pays each winning player an amount on both the ante bet and the odds bet. The ante bet is paid at a 1-to-1 rate by the house and the odds bet is paid at the odds listed in Table 2 for hands of Full House or lower. All of the payouts on ante and bets are made directly from the house's bank and do not affect the three jackpots at all. Because of the progressive nature of the three jackpots, and the fact that all three jackpots are paid out independent of each other, a high level of excitement can be generated.

In accordance with the invention, when dealer 9 pays each player his/her winnings, dealer 9 withholds a predetermined amount—one dollar ($1) in the example shown. The amounts are withheld from the winning players for each rank is added proportionally to the jackpots.

Turning now to FIGS. 2, 3 and 4, three rounds of the above-described game will be explained in further detail. In each of the drawing FIGS. 2 through 13, it is assumed that there are five players sitting at the playing table. Also, it is assumed in each of the FIGS. 2 through 13, that all the cards are dealt to the players face down and the cards that are dealt to dealer 9 are face down or selected ones may be dealt face up.

In each of FIGS. 2 through 13, the dealer's hand is shown at the top and the hands for each of the five players are shown below. The players are numbered from right to left as Players No. 1 through 5, and it is assumed that the normal rotation of dealing cards would be in a clockwise direction by dealer 9 such that dealer 9 would initially deal the first card to player 1.

In each of FIGS. 2 through 13, the suit of the cards is abbreviated with a letter designation of "H" for Hearts; "D" for Diamonds; "C" for Clubs; and "S" for Spades. Likewise, the face cards are identified by utilizing "A" for an Ace; "K" for a King; "Q" for a Queen; and "J" for a Jack.

Before each round of cards is dealt, it is also assumed that the cards will have been shuffled. Prior to the dealing of the cards by dealer 9, each player who desires to participate in the round must ante. As indicated in each of the FIGS. 2 through 13, the ante each player bets is $5. After each player who desires to participate in the round has anted up, dealer 9 deals five cards face down to each player and five cards to himself. The dealer's hand is dealt face down except the last card which is dealt face up.

In FIG. 2, the Ace of Clubs is identified as being dealt face up. Player 1 looks at his/her hand, realizes he does not have a jackpot winning hand and must decide to fold or to stay in. Player 1, having a pair of 6s, decides to stay in the game and bets an additional $5. Player 2, with Two Pair, i.e. a pair of 9s and a pair of 8s, decides to stay in the game and bets an additional $10. Player 3, looks at his/her hand, seeing that he has an Ace high hand, decides to stay in and bets an additional $5. Player 4, with a pair of Queens, decides to stay in the hand and bets an additional $5. Player 5 has an Ace high hand, decides to stay in the game and bids an additional $5. Dealer 9 then turns over all of his/her cards, the result being that he shows a pair of Aces. The dealer's hand has a higher poker ranking than the pair of 6s of Player 1, so Player 1 loses both his/her ante and his/her odds bet, for a total loss of $10. Player 2 has Two Pair and therefore has a higher poker rank hand than dealer 9. Player 2 wins on this hand and receives even money payoff on his/her ante and receives an odds payoff on his/her bid. According to Table 2, the odds payoff for Two Pair is an even money payoff. Therefore, the winnings of Player 2 can expect to be $5 for the ante and $10 for the second bet minus $1 which is retained by the house to place into the jackpots. Player 3 has a hand which does not beat the pair of Aces and therefore Player 3 loses both his/her ante and his/her second bet. Player 4 has a pair of Queens which does not beat the pair of Aces. Player 4 loses his/her ante and his/her second bet. Player 5 likewise has a hand which is of lower poker rank than the dealer's hand. Player 5 loses both his/her ante and the second bet.

Dealer 9 noting that there is the one winning hand, i.e., that of Player 2, punches in on his/her keypad 5 the number of winners, i.e., one, followed by the "#", and the jackpot monitoring system automatically calculates the portion of the $1 bet that should be allocated to each of the three jackpots.

Dealer 9 then picks up all the cards from this round and shuffles the cards again. Turning now to FIG. 3, each of the players must now decide whether to stay in the game. Player 5 decides not to play this round of cards and therefore does not ante. Players 1 through 4 each decide to play and each antes up $5. Dealer 9 then proceeds to deal a hand to each of Players 1 through 4 and to himself. All cards are again dealt face down, except for the last card to dealer 9, which is dealt face up. In this instance, the card that dealer 9 shows is a 2 of Clubs. Each of the players, 1 through 4, looks at the respective hand that was dealt to him. Player 3 has four 4s, i.e Four of a Kind, and therefore wins jackpot 3 for Four of a Kind. Player 3 signifies his/her winning of jackpot 3 by turning his/her cards over. Players 1, 2, and 4 can continue to play if they so desire. In fact, Player 1, after looking at his/her hand, decides to stay in and wages an odds bet of $5. Player 2, with a Straight, likewise decides to stay in the game and bets an additional $10. Player 4 has a Full House and likewise decides to stay in the game by betting $10. Dealer 9 then turns over all of his/her cards and shows a Full House with a pair of 5s and three 2s. The dealer's hand is of a higher ranking than Player 1. Player 1 loses both his/her $5 ante and his/her $5 second bet. Player 2 has a Straight, but a Straight is of lower poker rank than the Full House. Player 2 also loses and in this instance, loses his/her $5 ante and his/her odds bet of $10. Player 4 has a Full House which is higher Full House than that held by dealer 9. Player 4 therefore wins. The payoff for a Full House as shown in Table 2 is at 8-to-1 odds. Therefore, the house will pay to Player 4 the $5 for the ante and 8 times $10 or $80 for the odds bet, minus $1 which is retained for the jackpot. Player 4 therefore receives an $84 payoff plus he retains his/her original $15 of ante plus odds bets. Dealer 9 notes that there is one winning hand for which a payoff is being made out of the house bank and he enters the number 1 on his/her keypad 5, followed by the "#" key, and the jackpots are automatically adjusted accordingly. Dealer 9 then collects all the cards and shuffles them. The five players again must each decide whether to play in the next round. Turning now to FIG. 4, all five decide to play. All five ante $5.

Dealer 9 then deals the cards to each of the five players and to him/herself. All cards again being dealt face down, with the exception of the last card to dealer 9, which is dealt face up. The face up card to dealer 9 is a 2 of Clubs.

Player 1 looks at his/her hand and decides to stay in the game and wages an odds bet of $5. Player 2 looks at his/her hand and realizes that he has a jackpot winning Straight Flush and turns his/her cards over. Player 2 therefore wins jackpot 2 for the second highest poker rank of cards. Player 3 looks at his/her hand and turns his/her hand over because he holds a Royal Flush. Player 3 therefore wins jackpot 1. Player 4 has a hand which contains Four of a Kind and turns his/her cards over to win the jackpot 3. Player 5 looks at his/her hand and decides to fold. Player 5 therefore loses his/her ante. At this point, dealer 9 turns over his/her cards. Player 1 turns over all of his/her cards. Since Player 1 has a higher poker rank than dealer 9, Player 1 wins. From Table 2, the odds for a single high card hand are 1-to-1. Therefore Player 1 receives even money payoff on both his/her ante and his/her second bet or $10 minus $1 which is paid into the jackpots. Although FIG. 4 illustrates a round of hands which would be extremely rare, FIG. 4 is provided to illustrate that it is possible for three separate jackpots to all be won in one hand. All three jackpots are independent of each other.

GAME II

In a second embodiment of the invention, a qualifier hand is included as part of the game. In this second embodiment, a progressive jackpot is included in a manner similar to that described above with respect to the first embodiment. In the second game, dealer 9 shuffles the cards and each player signals participation in the round by placing an ante. Dealer 9 then proceeds to deal a hand of five cards to each of the players and deals seven cards to himself. All the cards dealt to the players are dealt face down. The cards dealt to dealer 9 may include a certain number of cards dealt face up and the remainder face down.

Players then look at their hands and at that time one of three things occurs as with the first game described, i.e. the player wins a jackpot, folds or continues to play. The player again may decide to fold, in which event, the player loses his/her ante to the house. Alternatively, the player may decide to proceed with the hand dealt and does so by placing an odds bet. The odds bet is placed on the symbol 3. The bet can be any amount up to double the flat or ante bet which was placed on symbol 2. If the player has one of the predetermined jackpot winning hands, the player automatically wins the corresponding jackpot.

If it is assumed that at least one of the players does not have a jackpot hand and has not folded but has desired to continue to play and has placed an odds bet, dealer 9 then turns the dealer's cards over so that all players can see the cards. In this embodiment of the invention, dealer 9 will arrange five of his/her dealt cards such that he plays the highest poker ranking of cards available and, in addition, takes two of his/her dealt cards that represent the second highest two card poker ranking in dealer 9s hand and sets those out as the qualifying hand. For example, if the seven cards that dealer 9 turns over includes an Ace of Hearts, a Queen of Spades, a Queen of Clubs, a 7 of Clubs, a 3 of Diamonds, a 3 of Hearts and a 2 of Spades, the highest hand playable by dealer 9 would be a hand including Two Pair. The second highest hand would be the high card combination of Ace and 7. In this event, each player who has opted to stay in the game, must beat the qualifying hand of an Ace and a 7. In the event that a player does not beat the Ace-7 combination in this round, the player loses his/her ante bet and retains his/her wager bet. In the event that the player has a hand which has a poker ranking higher than the Ace-7 combination, the player qualifies to have his/her hand played against the five card dealer hand. In the event that the player's hand has a higher poker ranking than the dealer's hand, the player wins. The player is paid even money on his/her ante bet and is paid odds as set forth in Table 2 on his/her odds bet. In addition, $1 is deducted from each total winning payout to be added to the progressive jackpots also as described above. In the event that the player's hand beats the qualifying hand but does not beat the dealer's hand, the player loses both his/her ante bet and his/her odds bet. This game has the additional interest value in that for each round of cards, there is a separate and different qualifier. By having a variable qualifier such as this, an element of excitement is added to the game.

Turning now to FIGS. 5, 6 and 7, three rounds of the game having the qualifier will be described. As shown in FIG. 5, there are again five players and dealer 9. In this instance, all five players ante to participate in the game. Dealer 9 shuffles the cards and proceeds to deal five cards to each of the five players and also deals five cards to himself plus two additional cards. All the cards are dealt face down, except the last two dealer cards are dealt face up. Each player then looks at his/her respective hand. If the hand is a jackpot winning hand, the player turns over his/her cards and wins the corresponding jackpot. If the hand is not a jackpot winning hand, the player must make a decision whether or not to continue to play in this round of the game. In this instance, all the players decide to stay in the game. Player 1 wagers an odds bet of $5. Player 2 wagers an odds bet of $10 and Players 3 through 5 all bet an additional $5. Dealer 9 then turns over the seven cards which he has been dealt and arranges his/her cards in the two highest hands. In this instance, the seven cards dealt to dealer 9 can be arranged into a first hand which is Two Pair with Aces and 4s. The second highest hand that dealer 9 can play is a pair of 2s. The pair of 2s is utilized as a qualifier. Player 1 has a hand which is a higher poker rank than the qualifying hand of a pair of 2s, so Player 1 qualifies. However, the hand of Player 1 is a lower poker rank than the hand of dealer 9. Player 1 therefore loses his/her ante and his/her odds bet. Player 2 has a hand which is higher than the qualifier, so Player 2 qualifies. Player 2, unfortunately, has a poker hand which is not as high a rank as the dealer's hand, so Player 2 loses both his/her ante and his/her odds bet.

Player 3 does not have a hand which is higher than the qualifier hand and therefore, Player 3 does not qualify. Player 3 therefore loses only his/her ante bet and his/her second bet is returned to him.

Player 4 holds a hand which has a higher poker rank than the qualifying hand. Player 4 therefore qualifies to play his/her hand against the dealer's hand but, unfortunately, Player 4's hand does not beat the dealer's hand and Player 4 loses both his/her ante and his/her odds bet.

Player 5 has a hand which does not beat the qualifying hand and therefore Player 5 loses the ante and keeps his/her odds bet.

Since there are no winners, dealer 9 collects all the cards and reshuffles them. Each player must then decide whether to participate in the second round as shown in FIG. 6. In FIG. 6, Player 5 decides not to play and does not ante. Players 1 through 4 all decide to play and each antes $5.

Dealer 9 then deals five cards face down to each of Players 1 through 4 and seven cards to himself with the last card being dealt face up. Each of the Players 1 through 4 looks at their respective hands. Player 3, in looking at his/her hand, identifies Four of a Kind as a jackpot hand, and places his/her cards face up to win jackpot 3.

Player 1 looks at his/her hand and decides to stay in the game and bets an additional $5 as an odds bet. Players 2 and 3 each likewise decide to stay in the game, and each of hem, likewise, bets an additional $10 as an odds bet.

With all players having made their decision, dealer 9 turns over all seven cards and arranges them to have the two highest poker rank hands. In so doing, he has a Full House with a pair of 5s and three 2s and a second highest hand of two cards is Queen high. Player 1 has a hand which is higher than the qualifying hand and therefore qualifies to play straight up against the dealer's hand. However, Player 1's hand has a lower poker rank than the dealer's hand and Player 1 loses. Player 1 loses $10, which is both his/her ante and his/her odds bet.

Player 2 likewise has a hand which is of higher rank than the qualifying hand but is lower than the poker rank of the dealer's hand and Player 2 loses. Player 2 loses $15, which again is equal to the ante plus the second bet.

The only remaining player is Player 4. Player 4 has a hand which is higher than the dealer's qualifying hand and therefore Player 4 plays directly against dealer 9. Player 4's hand has a higher poker rank than that of dealer 9. Player 4 therefore wins. The payoff to Player 4 is even money on the ante and odds according to Table 2 on the odds bet. The odds payoff for a Full House is 8-to-1. Therefore, Player 4 receives $5 for his/her ante plus eight times $10 for his/her second bet minus $1 withheld for the jackpot, or $84.00 total.

Dealer 9 adds the withheld $1 to the jackpots as described above. Dealer 9 then collects all the cards and begins shuffling them. Each of the five players must again decide to play the next round. As shown in FIG. 7, all five players ante $5. The cards are once again dealt with five cards dealt face down to each of the five players and seven cards to dealer 9, with one card to dealer 9 being dealt face up. Each of the players then views his/her dealt hand and decides whether to fold or to play unless the player has a jackpot hand. As it turns out, Player 2 holds a hand which is a Straight, and which entitles him to win jackpot 2. Player 2 therefore turns his/her hand over to win the jackpot. Player 3 has a hand which is a Royal Flush and wins the highest jackpot or jackpot 1. Player 4 holds a hand which is Four of a Kind. Player 4 therefore is entitled to win jackpot 3. Accordingly, Player 4 turns his/her cards over.

Player 1 views the cards in the hand dealt to him. If Player 1 also had a jackpot winning hand, he and the other winner of the same jackpot would split the jackpot. However, Player 1 does not hold a jackpot hand. Player 1 decides to stay in the game and wages an odds bet of $5. Player 5 decides not to continue and folds. Player 5 therefore will lose his/her ante.

At that point, dealer 9 turns over his/her cards and arranges them so that five of the cards are for the highest poker hand and two cards for the second highest poker hand as shown in FIG. 7. Player 1 has a hand which is a higher poker rank than the qualifying hand of dealer 9. Therefore, Player 1 is entitled to play his/her hand against the dealer's hand. Player 1 has a higher hand than the dealer's hand and therefore Player 1, wins. However, the poker rank of Player 1's hand is simply High Card and according to Table 2, Player 1 will win even odds on his/her odds bet. Player 1 therefore wins $5 for his/her ante and $5 for his/her odds bet minus $1 to be applied to the jackpots.

GAME III

In yet a third embodiment of the invention, a qualifying hand is also included in each round. Dealer 9 deals five cards to each player who antes up. Dealer 9 also deals five cards face down to himself, plus an additional two cards face down as a qualifier hand. Each player then looks at his/her hand and again either wins a jackpot or is confronted with the same choices as described with respect to the previous games of fold or place an odds bet. For each player that decides not to fold and places an odds bet, the game continues. At this point, dealer 9 will turn over the two card qualifying hand. Dealer 9 then turns over his/her remaining five card hand. If the dealer's hand beats the qualifying hand, each player plays straight up against the dealer's hand. If the player's hand beats the dealer's hand, the player again wins and is paid even money on the ante and paid odds, in accordance with Table 2, on the odds bet. In the event that the dealer's hand does not beat the qualifying hand, each player will win even money on the ante and have the odds bet returned. Dealer 9 will then collect all the cards, shuffle them, and deal a new round of hands.

Turning now to FIGS. 8, 9 and 10, three rounds of the game in accordance with this third embodiment are shown. Turning to FIG. 8, dealer 9 shuffles the cards. Each of the players must decide whether to participate in the game and the jackpot. All five players decide to do so, and each antes $5.

Dealer 9 deals five cards to each of the five players and seven cards to himself as a five card dealer's hand and a two card qualifying hand. Each player then determines whether a jackpot is won. Each player, failing to win a jackpot, then decides whether to continue playing his/her hand or not. In this instance, all five of the players decide to remain in and each places an odds bet. The odds bet for Players 1, 3, 4 and 5 is $5 and that for Player 2 is $10. After all the players have placed the odds bet, dealer 9 turns over the two cards of the qualifying hand and the five card dealer's hand so that they are face up. In this instance, the dealer's hand shows a pair of Aces. The qualifying hand is a High Card hand with a 5 as the high card. The dealer's hand is higher than the qualifying hand and therefore the players who stayed in the round play against dealer 9. Player 1 has a hand which is lower in poker rank than the pair of Aces held by dealer 9. Player 1 therefore loses his/her $5 ante and his/her $5 odds bet for a total loss of $10.

Player 2 has a higher poker rank hand with Two Pair over the One Pair held by dealer 9. Player 2 therefore wins. According to Table 2, Two Pair pays at even money, therefore, Player 2 wins $5 against his/her ante and $10 against his/her odds bet minus $1 for a total of $14. The $1 again being held for the jackpots.

Player 3's hand with a pair of 5s is a lower rank than the dealer's hand of a pair of Aces and Player 3 loses. Player 3 loses both the $5 ante and the $5 odds bet for a total of $10.

Player 4 has a pair of Queens which is of lower rank than the pair of Aces held by dealer 9, so Player 4 loses both his/her ante and odds bet or $10.

Player 5, unfortunately, has a hand which is less in poker rank than the dealer's hand and Player 5 loses both his/her ante and odds bet or $10.

Dealer 9 then shuffles the cards and each of the players once again must decide whether to participate in the game.

Turning now to FIG. 9, Players 1 through 4 decide to participate by each anteing $5. Player 5 does not. Dealer 9 then proceeds to deal five cards face down to each of Players 1 through 4, and seven cards to himself. Each of the players, 1 though 4, then looks at their respective hands, and decides whether to fold or to place an odds bet. Player 1 decides to lace an odds bet of $5. Players 2 and 4 decide to place odds bets of $10 each, and Player 3 turns over his/her cards and wins jackpot 3, since he has Four of a Kind.

Dealer 9 turns over the qualifying hand and the five card dealer's hand. The qualifying hand is a Queen-high hand.

The dealer's hand is Two Pair and therefore higher than the qualifying hand. The dealer's hand beats Player 1's hand and Player 1 loses his/her ante and his/her odds bet or $10 total. Player 2 holds a Straight which beats Two Pair and therefore, Player 2 has a hand that beats the dealer's hand. A Straight has an odds payoff of 3-to-1 according to Table 2 and therefore Player 2 wins $5 on his/her ante and $30 for his/her odds bet, minus $1 to be paid back into the jackpot, or $34 total.

Player 4 has a Full House which is a higher rank than Two Pair held by dealer 9. Player 4 therefore wins $5 for his/her ante and according to Table 2, 8-to-1 on the odds bet or eight times $10 for the odds bet minus $1 to be paid into the jackpot, or $84 total.

Dealer 9 then collects all the cards and shuffles them. Each of the players must then decide to play or not in the next round. All five players decide to play by anteing $5 as shown in FIG. 10. Dealer 9 deals five cards to each of the Players 1 through 5 and seven cards to dealer 9 with one card face up. Each of the players then looks at the hand dealt to them. Players 2, 3 and 4 each have jackpot winning hands, respectively winning jackpot 2, jackpot 1 and jackpot 3. The remaining players, Players 1 and 5, must decide whether to fold or play. Player 1 decides to continue playing and wages an odds bet of $5. Player 5 decides to fold and loses his/her ante of $5. Dealer 9 then turns over the dealer's hand and the qualifying hand. The dealer's hand does not beat the qualifying hand. Player 1 therefore is paid $5 for his/her ante bet and the odds bet is returned.

GAME IV

In still a fourth embodiment of the game, dealer 9 deals five cards face down to each of the players and deals five cards to himself and also a five card qualifier hand. As in the prior games, each player will view his/her cards and will either win a jackpot or must decide whether to fold or play. After each player has presented either a jackpot winning hand or has folded or has placed an odds bet, dealer 9 turns over the five card qualifying hand as well as the dealer's hand. In this version of the game, the dealer's hand must beat the qualifier hand straight up utilizing poker ranking. If the dealer's hand does not beat the qualifier hand, dealer 9 pays to each player who remained in the game, a payout on the ante bet. If, however, dealer 9 beats the qualifying hand, then each player plays his/her hand straight up against dealer 9. If the player's hand beats the dealer's hand, the player wins and receives a payout which is even money on his/her ante bet and odds in accordance with Table 2 on the odds bet, minus one dollar for the progressive jackpot. If the player's hand does not beat the dealer's hand, the player loses both his/her ante and his/her odds bet.

In this fourth embodiment of the game, the play is similar to that of the three prior games. Turning now to FIG. 11, each of the five players, Players 1 through 5, must decide to participate in a round or not. Players 1 through 5 each decides to participate and antes $5. Dealer 9 then proceeds to deal five cards to each of the Players 1 through 5 and, in this game, deals one five card hand as a dealer's hand and one five card hand as a qualifying hand. Each player then looks at his/her hand to determine whether or not the jackpot is won and failing to win a jackpot, decides whether to fold or place an odds bet. In this instance, none of the players wins a jackpot and all the players decide to place odds bets with Players 1, 3, 4 and 5 betting an additional $5 and Player 2 betting $10. Dealer 9 turns over both the qualifying and dealer's hands. The qualifying hand has a pair of 10s. The dealer's hand has a pair of Aces and beats the qualifying hand. Player 1 has a pair of 6's, which is a lower rank than a pair of Aces and therefore Player 1 loses his/her ante bet and his/her odds bet. Player 2's hand has a higher rank than the dealer's poker hand, because Player 2 holds Two Pairs. Player 2 therefore wins and, in this instance, Two Pairs pays even money. Therefore, Player 2 wins $5 against his/her ante and $10 against the odds bet, minus $1 to be retained and applied to the jackpots.

Player 3 has a hand which is lower than the dealer's hand and therefore loses the ante of $5 and his/her odds bet of $5.

Player 4 has a hand which is lower in rank than the dealer's hand and Player 4 loses both his/her ante and his/her odds bet.

Player 5 has a hand which does not beat the dealer's hand and therefore Player 5 loses his/her ante and his/her odds bet. Dealer 9 then shuffles the cards to begin another round of play.

Turning now to FIG. 12, Player 5 decides not to participate in this round and does not ante up. Players 1 through 4 each ante $5. Dealer 9 deals five cards to each Players 1 through 4, deals one hand as a qualifying hand, and one hand to himself. Each of the players, 1 through 4, look at their cards and decide whether to fold or to place an odds bet. Player 3, in looking at his/her hand, determines that he holds Four of a Kind, which pays a jackpot. Player 3 therefore turns his/her hand over to win the jackpot.

Each of Players 1, 2 and 4, after viewing their respective cards, decides to continue play. Player 1 places an odds bet of $5. Players 2 and 4 place odds bets of $10. Dealer 9 then turns over the qualifying hand and the dealer's hand. The dealer's hand beats the qualifying hand.

Player 1 holds a hand which is less than the dealer's hand. Player 1 therefore loses his/her $5 ante bet and his/her $5 odds bet.

Player 2 holds a hand which is of lesser rank than the dealer's poker hand. Player 2 therefore loses both his/her $5 ante bet and $10 odds bet or $15 total.

Player 4 holds a hand which is higher than the dealer's hand. Player 4 therefore wins and since Player 4 holds a hand which is a Full House, Player 4 is paid off at 8-to-1 odds on the odds bet. Player 4 therefore wins $5 for his/her ante and 8 times $10 for his/her odds bet, minus $1 to be paid into the jackpot, or $84 total.

Dealer 9 then collects the cards and shuffles them again. Each of the five players must again decide whether to play or not. Turning now to FIG. 13, all five players ante $5. Five cards are dealt face down to each of the five players and a five card dealer's hand and a five card qualifying hand are both dealt. Each of the players now views the cards which were dealt to them. Players 2, 3 and 4 each hold jackpot hands, and they turn their cards over. Player 1 decides to wage an additional $5 as an odds bet. Player 5 decides to fold. Player 5 therefore loses his/her $5 ante. Dealer 9 then turns over the qualifying hand and the dealer's hand. The dealer's hand beats the qualifying hand. Player 1 has a hand which does not beat the dealer's hand, therefore Player 1 loses) his/her ante of $5 and his/her odds bet of $5.

Thus, in each of these last three games, a different qualifier hand is used for each round. In the first two games having a qualifying hand, dealer 9 always qualifies and the players must qualify against the qualifying hand. In the event the player does not qualify, he risks only his/her ante. In the event that the player qualifies, his/her hand is then played straight up against the dealer's hand and the player will either lose both his/her ante and his/her odds bet, or he will win a payout of even money on the ante and odds on the odds bet minus one dollar for the progressive jackpot. In the last game described, dealer 9 has to beat the qualifying hand. If dealer 9 does not beat the qualifying hand, each player remaining in the game is paid even money on the player's ante bet and a new round will then be started.

The invention has been described in terms of a specific embodiment, but it will be understood by those skilled in the art that various modifications may be made to the invention without departing from the spirit or scope thereof. Accordingly, invention is intended to be limited only by the following claims.

What is claimed is:

1. A method of including a progressive jackpot component in a live casino table game comprising the steps of:

providing at least a standard deck of playing cards;

a player wagering a first bet to participate in the live casino game and thereby automatically participate in said jackpot component, said first bet not having any predetermined portion allocable to participate in said progressive jackpot;

a dealer dealing a hand of playing cards to said player; and if said player's hand comprises a first predetermined arrangement of cards, said player wins a first jackpot, said jackpot component being progressive in that the amount of said first jackpot that is not won on one first hand carries over to a next hand.

2. The method of claim 1, wherein:

if said player's hand comprises a second predetermined arrangement of cards, said player wins a second jackpot.

3. The method of claim 2, wherein:

said jackpot component is progressive in that the amount of said first jackpot that is not won on said hand carries over to a next hand, and the amount of said second jackpot that is not won on said first hand, carries on to said next hand.

4. The method of claim 3, wherein said casino table game is Five Card Stud Poker.

5. A method in accordance with claim 1, wherein:

said player either decides to fold or to wage a second bet to continue playing in said casino table game; and if said player wages said second bet, said player's hand is compared to a hand dealt to the dealer, and if said player's hand is higher in rank than said dealer's hand, said player wins an amount which is a pre-determined multiple of said player's second bet based upon the rank of said player's hand.

6. A method in accordance with claim 1, wherein:

said player either decides to fold or to wage a second bet to continue playing in said casino table game; and wherein if said player wages said second bet, said player's hand is compared to a hand dealt to the dealer, and if said player's hand is higher in rank than said dealer's hand, said player wins an amount which is a predetermined multiple of said player's second bet based upon the rank of said player's hand.

7. A method of including a jackpot in a casino table game comprising the steps of:

providing at least a standard deck of playing cards;

a player wagering a first bet to participate in the live casino game and in said jackpot component;

a dealer dealing a hand of playing cards to said player;

said dealer deals cards to said dealer;

said dealer's cards comprising a qualifying hand and a dealer's hand for the round of the game being played;

if said player's hand comprises a first predetermined arrangement of cards, said player wins a first jackpot;

if said player's hand does not have a predetermined arrangement of cards corresponding to winning a jackpot, said player either decides to fold or to wage a second bet to continue playing in said casino table game;

if said player wages said second bet, said player comparing said player's hand to said qualifying hand to determine whether said player continues play;

if said player's hand beats said qualifying hand, said player's hand is compared to said dealer's hand, and if said player's hand is higher in rank than said dealer's hand, said player wins an amount which is a predetermined multiple of said player's second bet based upon the rank of said player's hand.

8. A method in accordance with claim 7, wherein:

if said player's hand does not have a predetermined rank relative to said qualifying hand, said player loses.

9. A method in accordance with claim 8, wherein:

said predetermined rank is a rank higher than said qualifying hand.

10. A method in accordance with claim 9, wherein:

if said player's hand does not have a rank higher than said qualifying hand, said player loses only said first bet, and said player's second bet is returned to said player.

11. A method in accordance with claim 7, wherein:

if said player's hand has a higher rank than said qualifying hand, said player's hand is compared in rank to said dealer's hand, and if said player's hand is lower in rank than said dealer's hand, said player loses both said first and second bets.

12. A method in accordance with claim 11, wherein:

if said player's hand is of a rank higher than said dealer's hand, said player wins a payoff based upon his first and second bets.

13. A method in accordance with claim 12, wherein:

said payoff includes an even money payoff of said first bet.

14. A method in accordance with claim 13, wherein:

said payoff includes an odds payoff of said second bet and said odds payoff is a predetermined multiple of said second bet based upon the rank of said player's hand.

15. A method in accordance with claim 13, wherein:

a predetermined portion of said payoff is allocated among a plurality of jackpots including said first jackpot in accordance with a predetermined formula.

16. A method in accordance with claim 7, wherein:

said player's hand consists of a predetermined number of cards and said dealer's cards consist of said predetermined number and a predetermined number of additional cards.

17. A method in accordance with claim 16, comprising:

said dealer selecting from said dealer's cards said dealer's hand and said qualifying hand.

18. A method in accordance with claim 16, comprising:

said dealer first selecting said dealer's hand from said dealer's cards and then selecting said qualifying hand from said dealer's cards.

19. A method in accordance with claim 16, wherein:

said dealer's cards are dealt as said qualifying hand and dealt as said dealer's hand.

20. A method in accordance with claim 19, wherein:

each of said player's hand, said dealer's hand and said qualifying hand consist of said predetermined number of cards.

21. A method of including a jackpot in a casino table game comprising the steps of:

providing at least a standard deck of playing cards;

a player wagering a first bet to participate in the live casino game and in said jackpot component;

said jackpot component is progressive in that the amount of said first jackpot that is not won on one first hand carries over to a next hand;

a dealer dealing a hand of playing cards to said player;

said dealer deals cards to said dealer;

said dealer's cards comprising a qualifying hand and a dealer's hand for the round of the game being played;

if said player's hand comprises a first predetermined arrangement of cards, said player wins a first jackpot;

if said player's hand does not have a predetermined arrangement of cards corresponding to a winning jackpot, said player either decides to fold or to wage a second bet to continue placing in said casino table game;

if said player wages said second bet said player comparing said player's hand to said qualifying hand to determine whether said player continues play;

if said player's hand beats said qualifying hand, said player's hand is compared to said dealer's hand, and if said player's hand is higher in rank than said dealer's hand, said player wins an amount which is a predetermined multiple of said player's second bet based upon the rank of said player's hand.

22. A method in accordance with claim 21, wherein:

if said player's hand does not have a predetermined rank relative to said qualifying hand, said player loses.

23. A method in accordance with claim 22, wherein:

said predetermined rank is a rank higher than said qualifying hand.

24. A method in accordance with claim 23, wherein:

if said player's hand does not have a rank higher than said qualifying hand, said player loses only said first bet, and said player's second bet is returned to said player.

25. A method in accordance with claim 21, wherein:

if said player's hand has a higher rank than said qualifying hand, said player's hand is compared in rank to said dealer's hand, and if said player's hand is lower in rank than said dealer's hand, said player loses both said first and second bets.

26. A method in accordance with claim 25, wherein:

if said player's hand is of a rank higher than said dealer's hand, said player wins a payoff based upon his first and second bets.

27. A method in accordance with claim 26, wherein:

said payoff includes an even money payoff of said first bet.

28. A method in accordance with claim 27, wherein:

said payoff includes an odds payoff of said second bet and said odds payoff is a predetermined multiple of said second bet based upon the rank of said player's hand.

29. A method in accordance with claim 27, wherein:

a predetermined portion of said payoff is allocated among a plurality of jackpots including said first jackpot in accordance with a predetermined formula.

30. A method in accordance with claim 21, wherein:

said player's hand consists of a predetermined number of cards; and said dealer's cards consist of said predetermined number of cards and a predetermined number of additional cards.

31. A method in accordance with claim 30, comprising:

said dealer selecting from said dealer cards said dealer's hand and said qualifying hand.

32. A method in accordance with claim 30, comprising:

said dealer first selecting said dealer's hand from said dealer cards and then selecting said qualifying hand from said dealer cards.

33. A method in accordance with claim 30, wherein:

said dealer cards are dealt as said qualifying hand and dealt as said dealer's hand.

34. A method in accordance with claim 33, wherein:

each of said player's hand, said dealer's hand and said qualifying hand consist of the same predetermined number of cards.

* * * * *